United States Patent [19]

Barnard

[11] 4,398,734

[45] Aug. 16, 1983

[54] TRUCK DESIGN FOR A SKATE-TYPE DEVICE

[76] Inventor: Robert G. Barnard, 312 University Ave., Apt. #8, Davis, Calif. 95616

[21] Appl. No.: 222,621

[22] Filed: Jan. 5, 1981

[51] Int. Cl.[3] ..... A63C 17/02

[52] U.S. Cl. ..... 280/11.28; 280/87.04 A

[58] Field of Search ..... 280/11.28, 11.27, 11.23, 280/11.19, 87.04 R, 87.04 A

[56] References Cited

U.S. PATENT DOCUMENTS

| | | | |
|---|---|---|---|
| 1,640,134 | 8/1927 | Salberg | 280/11.19 |
| 2,547,796 | 4/1951 | Swensson | 280/11.28 |
| 2,822,182 | 2/1958 | Merbler | 280/11.28 |
| 2,959,423 | 11/1960 | Dornseif | 280/11.28 |
| 4,220,112 | 9/1980 | Neilsen | 280/11.19 X |
| 4,262,918 | 4/1981 | Sondino | 280/11.28 X |

FOREIGN PATENT DOCUMENTS

| | | | |
|---|---|---|---|
| 461506 | 12/1913 | France | 280/11.28 |

*Primary Examiner*—Robert J. Spar

*Assistant Examiner*—Donald W. Underwood

*Attorney, Agent, or Firm*—Beehler, Pavitt, Siegemund, Jagger & Martella

[57] ABSTRACT

A truck design for a skate-type device involving turning and tilting axes or rotation embodied in the form of a T-shaped rod, the top part being housed in a base plate, and the leg passing through a slot in the base plate, a resilient pad, washers, an axle yoke, and an adjustable lock nut. Steering action occurs as the axle yoke pivots around the T-rod leg, and the rotation of the yoke in respect to board and base plate tilt is governed by transmitting rotation about the tilting axis to rotation about the turning axis by means of a rounded end of an axle yoke extension which fits into a slot in the base plate extension. As the board is tilted, the base plate extension is tilted sideways with respect to the still-vertical T-rod leg, pushing the axle yoke extension sideways to steer the axle like a wagon yoke. In one form of the invention, coupled action between front and rear trucks is provided by joining the respective T-rod legs either in a unitary structure or by a telescoping contruction.

13 Claims, 14 Drawing Figures

TRUCK DESIGN FOR A SKATE-TYPE DEVICE

BACKGROUND OF THE INVENTION

1. Field of the Invention

My truck design pertains to skateboards, roller skates, scooters, and other skate-type devices which utilize tilting action for steering control.

2. The Prior Art

Most present trucks utilize a single axis of rotation which is an an acute angle with respect to the baseplate. The rotation of the axle yoke around the axis has both vertical and horizontal components of motion. When the rider rocks the board, one side moves up and the other side moves down. The axle rotates about the axis to accommodate the vertical change, which results in the displacement of the axle ends horizontally to produce steering action.

The prior art skate trucks feature a baseplate or soleplate which is securely fastened to the skateboard or rollerskate shoe. A wheel axle is suspended from the baseplate by rigid members. The most common truck uses a metal ball socket and a metal bolt to suspend the axle from the baseplate. These small, rigid connections experience high concentrated stresses and are prone to breakage. My truck features a T-rod and resilient pad, to bear the load from the axle to the baseplate. Neither of these parts is rigidly fixed so that breakage from sudden shock stresses are avoided. The contact surfaces between the axle yoke, T-rod, resilient pad, and baseplate are large in my design to avoid concentrated stresses. And, the resilient pad flexes to absorb shock.

The prior art skate trucks usually lack mechanical features within the truck by which the truck height and the truck steering radio can be adjusted. My truck has mechanical features by which height and steering ratio are adjustable. By providing height adjustment the skater can optimize the skateboard or roller skate riding characteristics. For small wheels, the skater can lower the truck to obtain a low stable skateboard or roller skate. Also, the skater can make the trucks taller to accomodate larger wheels.

Steering ratio adjustments change the ratio of skateboard or roller skate turning to rider tilt of the roller skate or skateboard. Typically, the standard way to adjust the skateboard steering ratio is to use a longer or shorter board. Given the same truck configuration, a short board will turn sharper than a long one. Roller skate steering ratios cannot be easily modified at all. By use of a truck with an adjustable steering ratio as disclosed in the present invention, a skateboard can be provided with different turning characteristics obtainable with a single board and a roller skate can be tuned to provide varyable steering. It is also possible with the present invention to adjust the steering ratios of each truck independently to thereby further modify the riding characteristics.

In addition to the foregoing, the prior art skate truck did not have a provision by which the trucks could be linked so as to turn together. By linking or joining the turning legs as disclosed in the present invention, mechanical synchronization between the trucks can be achieved. With synchronized turning, all four wheels are assisted in being maintained on the ground. Also, synchronized turning helps to maintain constant skateboard or roller skate tilting stiffness, even when the skater is riding on one truck only.

SUMMARY OF THE INVENTION

A truck design for a skate-type device is revealed in which the basis of the system for turning and tilting axes of rotation is developed from a construction using a T-shaped or L-shaped steering rod. The top part is housed in the baseplate and a leg passes through a slot in the baseplate, where in it is secured against a resilient pad with some interposed washers, an axle yoke and an adjustable lock nut.

Steering action occurs as the axle yoke pivots around the T-rod leg. The rotation of the yoke is governed with respect to board tilt and hence, baseplate tilt, by transmitting rotation about the tilting axis to rotation about the turning axis. The transmission can be done by a rounded end of the axle yoke extension which fits into a slot in the base plate extension. As the board is tilted, the base plate extension is tilted sideways with respect to the still-vertical T-rod leg, pushing the axle yoke extension sideways to steer the axle like a wagon yoke.

A resilient pad is compressed between the axle yoke and the baseplate by an adjustable lock nut on the T-rod leg. The pad restricts rotation between the base plate and the T-rod to resist turning action.

DETAILED DESCRIPTION

Figure 1:
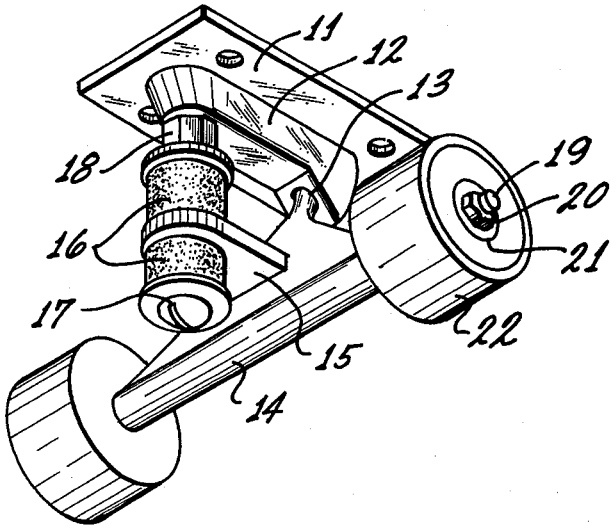
FIG. 1 PRIOR ART
FIG. 1 is a general view illustrating the prior art truck design.

The prior art truck design is illustrated in FIG. 1. Baseplate 11 provides attachment to a skateboard. Baseplate features a raised section 12 which provides threaded securement for action bolt 17 and engagement for axle yoke 14 by socket 13. An annular extension 15 of the axle yoke 14 is supported by resilient pads 16. Action bolt 17 passes through resilient pads 16, axle yoke extension 15, lock nut 18, and baseplate section 12. A wheel 22 is held by bearings 21 and lock nut 20. Axle 19 extends through axle yoke 14, wheel bearings 21, and lock nut 20.

Axle yoke extension 15 and socket 13 are two points which define a pivot axis of rotation between axle yoke 14 and baseplate 11. The pivot axis is at an acute angle of approximately 45 degrees from the horizontal. When the skateboard is tilted by the rider, one axle end moves toward the baseplate and toward the action bolt while the other axle end moves away from the baseplate and away from the action bolt as axle yoke 14 is rotating about the pivot axis. The forward and backwards displacement of the axle ends results in the horizontal turning of axle 19 and the steering of wheels 22. The rotation of axle yoke 14 about the pivot axis twists axle yoke extension 15 to compress one side of both resilient pads 16. The resistance to turning that is caused by resilient pads 16 facilitates rider control by preventing small forces from initiating large steering actions.

Figure 4:
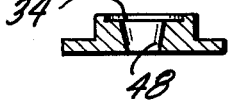
FIG. 4 is a section through FIG. 3 showing resilient pad seat and hole for T-rod leg.
Figure 8:
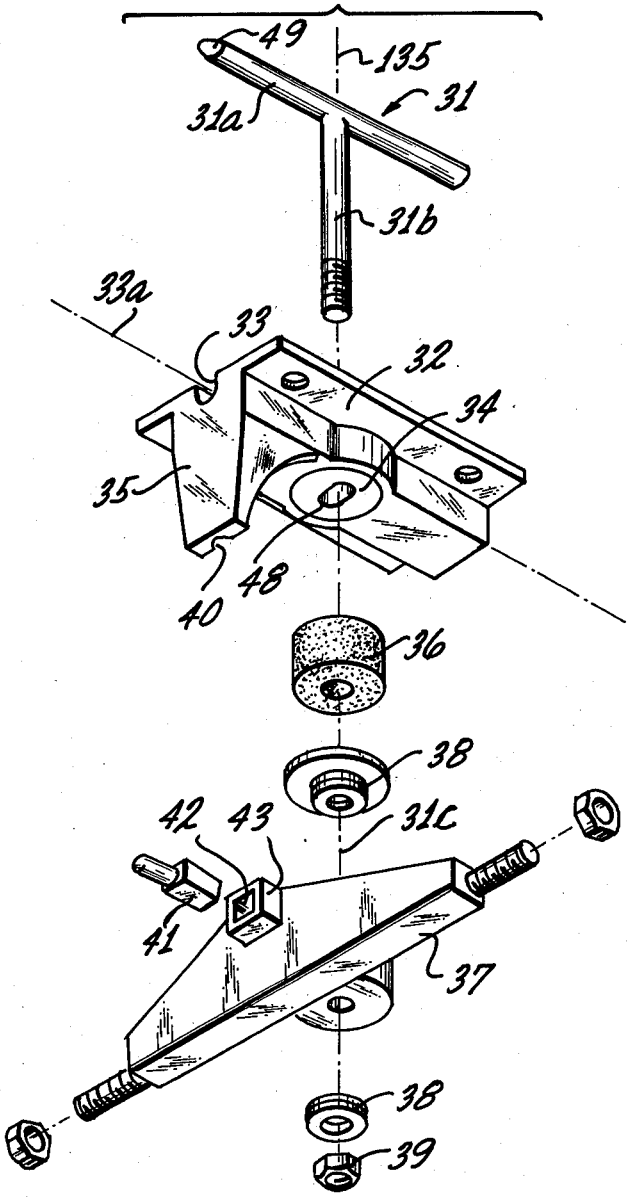
FIG. 8 is an exploded view that illustrates my truck design assembly.

My truck design is illustrated in FIGS. 2–8 and includes a T-rod 31 mounted for rotation about the longitudinal axis of its upper member 31*a* and has a downwardly extending or depending member or leg 31*b* which serves as a steering axle as will be described. A baseplate 32 is fastened to a skateboard or skate (not shown). The baseplate includes means forming a T-rod slot 33, a resilient pad seat 34, and a baseplate extension or leg 35. The T-rod slot 33 is an indentation or groove formed along the center of the upper portion of the baseplate 32 as shown in FIGS. 1 and 8. T-rod 31 is contained in T-rod slot 33; the T-rod leg 31*b* passing through hole 48 as shown in FIG. 4. Clearance in hole 48 for the T-rod leg enables baseplate 32 to swing like a hinge around T-rod 31 approximately 30 degrees from the horizontal in such a manner that the axis of baseplate 32 rotation about T-rod defines the tilting or longitudinal axis 33*a* of the skateboard, FIG. 8. The flat surface 49 on top of T-rod 31 enables the axis of T-rod rotation to be located close to the undersurface of the skateboard, thereby minimizing the distance between the rider's feet and the tilting axis, FIG. 8. Resilient pad seat 34 secures and supports the top of resilient pad 36.

Figure 5:
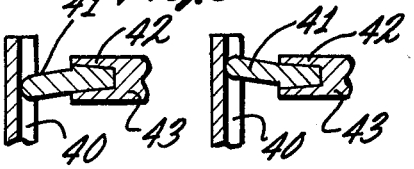
FIG. 5 is two cross-sectional views that show the engagement piece at two different adjustments.
Figure 6:
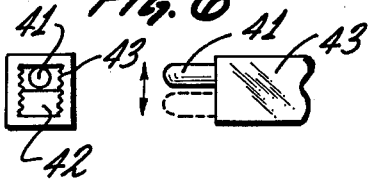
FIG. 6 is an illustration of an alternate engagement piece and corresponding axle yoke extension.
Figure 7:
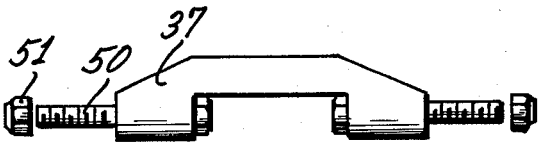
FIG. 7 is an illustration of an alternate means of securing the wheels by the use of a split axle.

The axle yoke extension 43 which engages the baseplate extension is comprised of a socket 42 and engagement piece 41. The rounded end of engagement piece 41 is off-center from the socket 42 in which it is inserted, FIG. 5. Engagement piece 41 can be inserted into the socket 42 in two ways. The rounded end of engagement piece 41 is in either an upper or a lower position. This action changes the vertical position where engagement piece 41 engages baseplate extension 35 and the effective length of the turning arm in slot 40. An alternate means of adjusting the vertical position of the axle yoke extension engagement is shown in FIG. 6. Notched teeth on the vertical surfaces of engagement piece 41 and the socket 42 can interlock to hold engagement piece 41 at any of several vertical positions.

The leg of T-bolt 31 passes through baseplate 32, resilient pad 36, spacing washers 38, axle yoke 37, and lock nut 39, FIG. 8. Axle yoke 37 can rotate about this leg of T-rod 31 which serves as a steering axle defining a steering axis 31*c*. Wheels 47 are held by bearings 46, FIG. 1 and axle 44 and nut 45 secure the bearings. In an alternative assembly, the axle is split, FIG. 7 wherein the axle bolt 50 and nut 51 secure each wheel.

My truck design works as follows. When the rider shifts his foot pressure to one side of the skateboard, the skateboard tilts and baseplate 32 rotates about T-rod 31, FIG. 1. Rotation of baseplate 32 compresses one side of resilient pad 36 between pad seat 34 and washers 38. The expansive reaction of resilient pad 36 upon pad seat 34 regulates the tilting of baseplate 32 to prevent excessive leaning of the skateboard. A heavy rider would typically want a stiffer leaning skateboard than a light rider would. The firmness or softness of skateboard tilt can be adjusted by turning lock nut 29 which exerts force through washers 38 and axle yoke 37 to precompress resilient pad 36. As resilient pad 36 is compressed shorter, the force required for further compression increases. Thus, the precompression of resilient pad 36, which is adjusted by lock nut 39, determines the force a rider uses to compress it further when the skateboard is leaned. Therefore, adjustment of locknut 39 varies skateboard leaning stiffness.

The tilting action of baseplate 32 is transmitted to turning action of axle yoke 37 about T-rod 31 by the coupling engagement between the baseplate extension or arm 35 and axle yoke extension or arm 43. When baseplate 32 tilts, baseplate extension 35 swings laterally with respect to the still-vertical T-rod 31. This pushes axle yoke extension 43 sideways at the point of engagement to pivot axle yoke 37 around T-rod 31 which results in the steering motion described.

Baseplate extension 35 is flexible in the longitudinal direction, FIG. 1. When axle yoke extension 43 is in place, baseplate extension 35 presses firmly upon it to maintain solid contact. The spring action of baseplate extension 35 maintains firm engagement in spite of a small retraction of axle extension 43 from the baseplate extension 35 during turning and is spite of eventual wear to the engagement surfaces. Braces or gussets 55 of baseplate extension 35 are thin and slightly curved, FIG. 3. Braces 55 permit flexing of baseplate extension 35 but if baseplate extension 35 is forced away from axle yoke extension 43, the slight curve in braces 55 flattens, and the braces act as guys, preventing further bending.

A rider would typically want a skateboard that turns sharply for freestyle and a board that turns gradually for downhill. The turn of axle yoke 37 for a given tilt of the skateboard is adjustable by setting engagement piece or finger 41 which engages a slot 40 in the baseplate extension 35 to vary the vertical distance from it to T-rod 31, FIG. 1. When the skateboard is leaned at a given angle, base-plate extension 35 tilts sideways at the same angle. However, the distance that engagement piece 41 is pushed depends on the length of the lever pushing it which is the distance from it to T-rod 31. The distance that engagement piece 41 is pushed, in turn, determines the angle that the axle yoke will turn. Hence, the vertical position of engagement piece 41 varies the skateboard turning radius or sharpness.

The height of the truck is adjustable to accommodate various wheel sizes and ground clearance requirements. Washers 38 can be added or taken from between axle yoke 37 and resilient pad 36, thereby raising or lowering baseplate 32.

Figure 9:
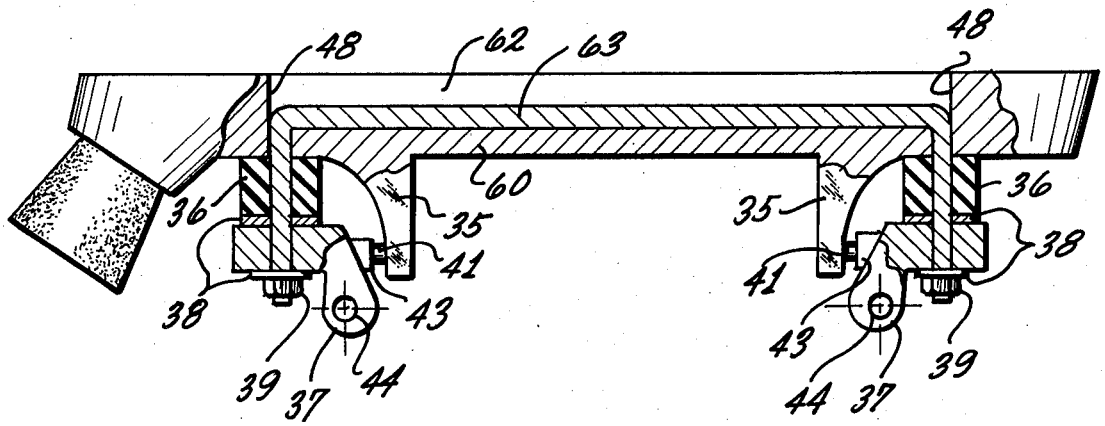
FIG. 9 is an illustration of the application of my truck design to roller skates.

An application of my truck design to roller skates is illustrated in FIG. 9. The truck assembly is identical to that of a single skateboard truck except that both trucks share a common baseplate, which is sole plate 60, and share a common T-rod, which is U-rod 63. The skate shoe is fastened on top of sole plate 60. U-rod 63 lies in groove 62 with its legs extending through the holes 48, resilient pads 36, washers 38, axle yokes 37, and lock nuts 39 of the two truck assemblies. Sole plate 60 can rotate about U-rod 63 approximately 30 degrees from the horizontal. Sole plate extensions 35 extend from sole plate 60 to engage axle yoke extensions 43 of the truck assemblies. Engagement pieces 41 can be vertically adjusted as shown in FIGS. 5 and 6. U-rod 63 links both trucks so that they turn together. This assembly gives the skater the full stiffness of the roller skate even if he is riding only on one truck. An enlarged version of the sole plate can become the deck of a skateboard.

Figure 10:
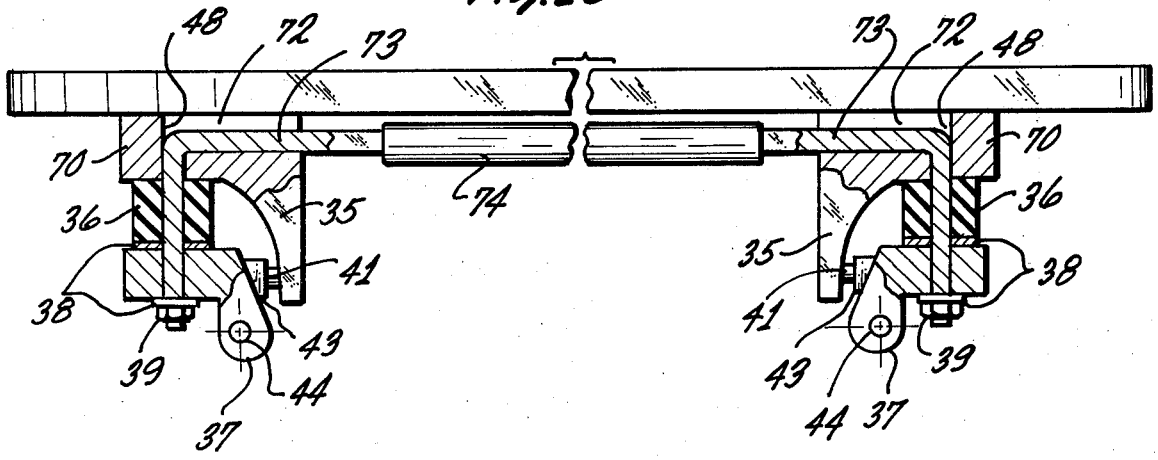
FIG. 10 is an illustration of a skateboard assembly with the additional feature that the turcks are linked to turn together.
Figure 11:
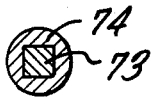
FIG. 11 is a cross-sectional view of the telescoping L-rod connection of FIG. 10.

A method in which the trucks can be fastened on a separate skateboard and linked to turn togehter is illustrated in FIG. 10. The truck assembly is identical to that of the single skateboard truck except for base plate and T-rod modifications. L-shaped rod 73 fits in groove 72 in base-plate 70 with its leg extending through hole 48, resilient pad 36, washers 38, axle yoke 37, and lock nut 39 of a truck assembly. Rod 74 engages L-rod 73. The connection of rod 74 to L-rod 73 may allow longitudinal movement at one or two places. The squared, sliding engagement allows the assembly to telescope but not to rotate, FIG. 11. Thus, it can fit different-sized skateboards and still link both trucks together.

Figure 2:
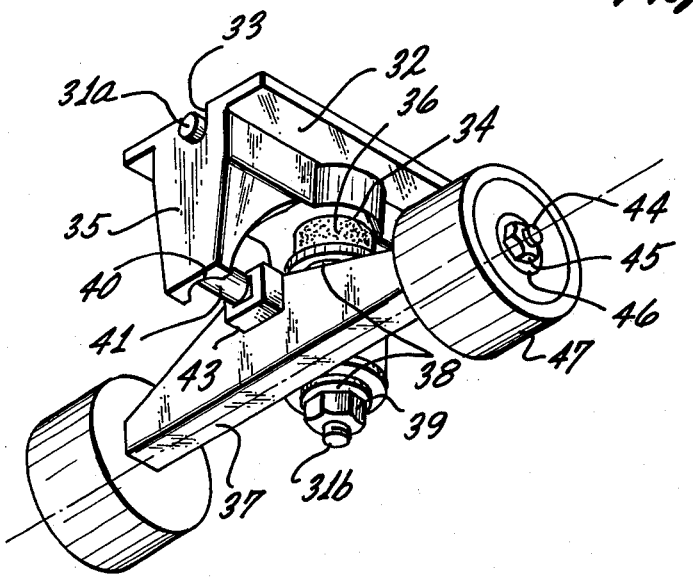
FIG. 2 is a general view illustrating my truck design.
Figure 3:
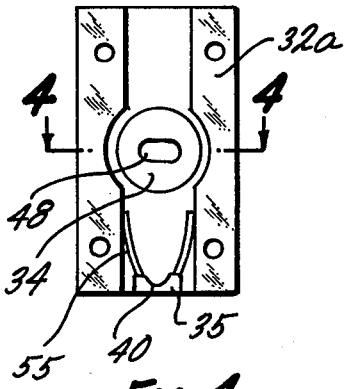
FIG. 3 is a plan view of the baseplate with baseplate extension and resilient pad seat.
Figure 12:
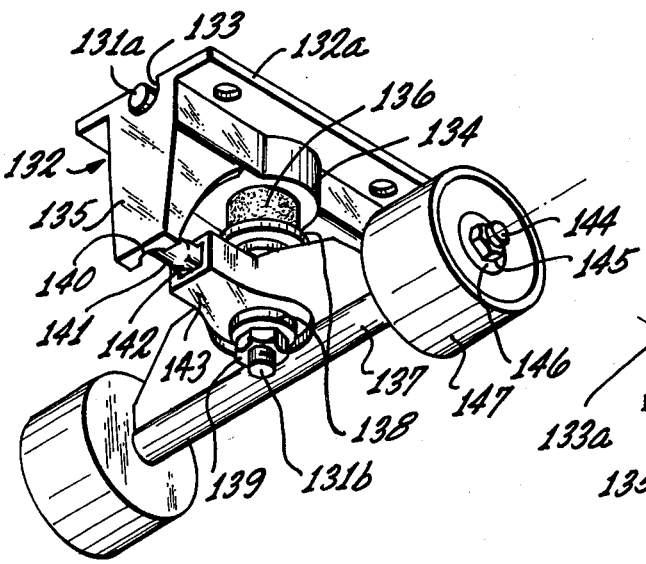
FIGS. 12 and 13 is an illustration of a modified truck design similar to FIGS. 2 and 8 constructed in accordance with the present invention.
Figure 13:
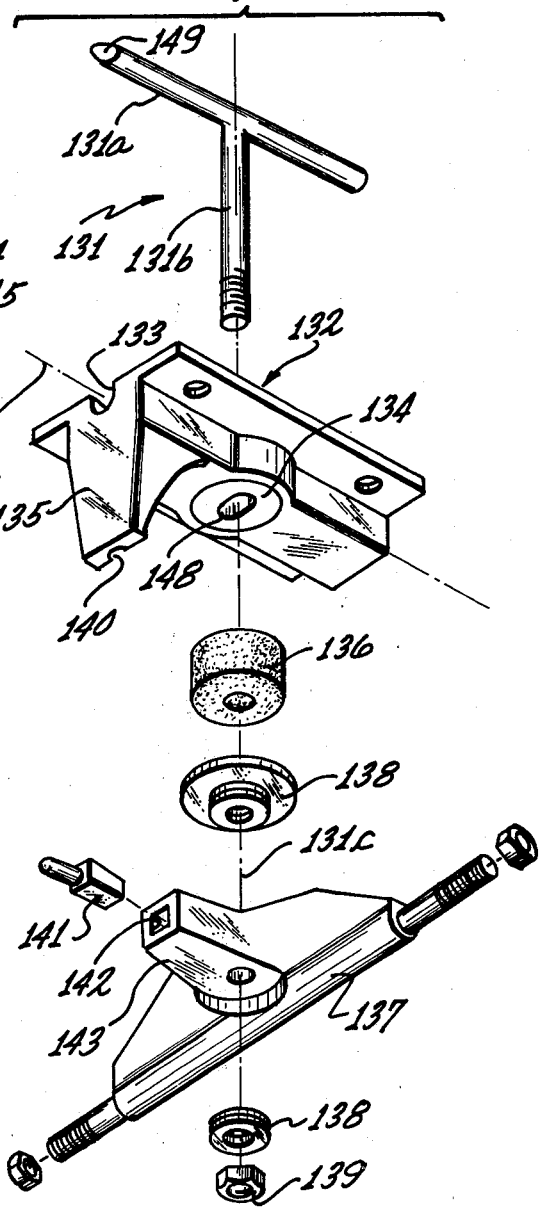
Figure 14:
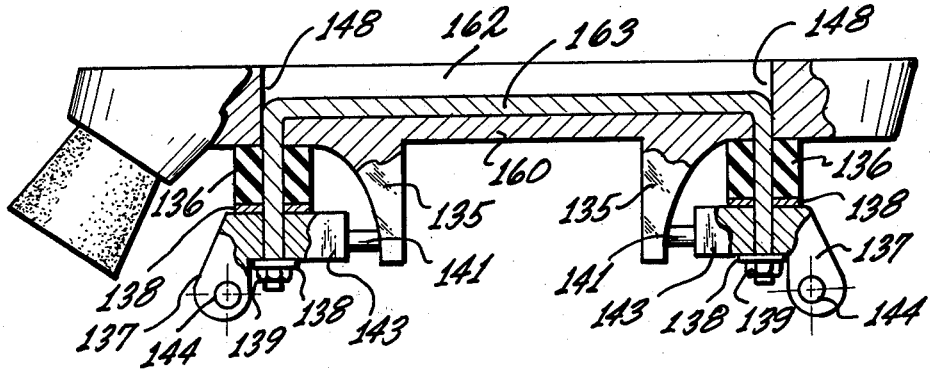
FIG. 14 is an illustration of a modified truck assembly similar to FIG. 10 and constructed in accordance with the present invention.

FIGS. 12, 13 and 14 are modified truck assemblies similar to that of FIGS. 2, 8 and 10 showing a construction in which the wheel axle is located outwardly of the center of the skateboard or skate and on the side away from the turning mechanism. Like parts have been given the same numbers raised by 100 for ease of identification and to avoid further description. In practice, it has been found that the structures of FIGS. 2 and 10, in which the wheel axis is inboard, is more stable and is therefore to be preferred.

What is claimed is:

1. In a skate, such as a skate board or roller skate, a wheel supporting truck assembly comprising:

a base member for mounting to said skate;

a tilt axle rotatably mounted to said base and oriented generally parallel to the plane of said skate;

a steering axle connected generally at a right angle to said tilt axle;

a yoke assembly mounted for rotation about said steering axle, said yoke including a wheel axis and a pair of wheels rotatable about said axis;

means yieldably urging said steering axle into normally perpendicular relationship with respect to said base member;

a leg depending downwardly from said base member, and leg engaging means associated with said yoke and engaging said leg at a location displaced from the axis of rotation of said tilt axle such that rotation of said base member about said tilt axle causes said leg member to be displaced laterally in an arc, thereby turning said yoke about said steering axle in a plane generally perpendicular to the arc of said leg.

2. A skate as in claim 1 further comprising means for adjusting the relative lengths of said leg and said tongue to thereby change the tilt-steering ratio of said assembly.

3. A skate as in claim 1 further comprising means for adjusting the height of said base member relative to said wheel axis.

4. A skate as in claim 1 wherein said means for yieldably urging comprise one or more resilient pads mounted to said steering axle between said yoke and said base member.

5. A skate as in claim 1 further comprising one or more removable shims disposed between said yoke and said base member such that the spacing between said yoke and said base member is adjustable by removal or insertion of said shims.

6. A skate as in claim 1 further including means for adjusting the precompression of said resilient pads to thereby establish the initial tilt resistance of said truck assembly to movement about said tilt axle.

7. A skate as in claim 1 further including a second wheel supporting truck assembly attached to said skate and constructed in the same manner as described.

8. A skate as in claim 7 in which the tilt axle of one truck assembly is interconnected for unitary movement with the tilt axle of the other truck.

9. The truck assembly of claim 7 wherein the tilt axles and steering axles of both said trucks are a single U-shaped rod.

10. The skate as in claim 1 in which the yoke assembly is constructed with the wheel axis located between said leg and said steering axle.

11. The truck assembly of claim 1 wherein said tilt axle and said steering axle are a unitary T-shaped bolt.

12. The truck assembly of claim 1 wherein said tilt axle and said steering axle are a unitary L-shaped rod.

13. The truck assembly of claim 7 wherein both said trucks share a common base member.

* * * * *